United States Patent [19]

Petzold et al.

[11] Patent Number: 4,474,668

[45] Date of Patent: Oct. 2, 1984

[54] SMOOTHING AGENTS FOR TEXTILE FIBERS

[76] Inventors: Manfred Petzold, Am Falder 93, 4000 Düsseldorf-Holthausen; Peter Waltenberger, Druckerweg 14, 4010 Hilden; Rudolf Veitenhans, Röntgenstrasse 33, 5657 Haan; Claudia Haak, Koehlstrasse 7, 4000 Düsseldorf 30, all of Fed. Rep. of Germany

[21] Appl. No.: 488,330

[22] Filed: Apr. 25, 1983

[30] Foreign Application Priority Data

Oct. 16, 1982 [DE] Fed. Rep. of Germany ..... 3238395

[51] Int. Cl.[3] ..... D06M 13/38

[52] U.S. Cl. ..... 252/8.6; 8/115.6; 252/8.8; 252/8.9

[58] Field of Search ..... 252/8.6, 8.8; 8/115.6

[56] References Cited

U.S. PATENT DOCUMENTS 4,122,018 10/1978 Waltenberger et al. ..... 252/8.6
4,201,680 5/1980 Waltenberger et al. ..... 8/115.6

*Primary Examiner*—Theodore E. Pertilla

[57] ABSTRACT

Smoothing agents in the form of an aqueous emulsion for textile fibers, composed of oxidized polyethylene, a cationic emulsifier, and a lower carboxylic acid or hydroxy carboxylic acid, and optionally, other ingredients.

11 Claims, No Drawings

SMOOTHING AGENTS FOR TEXTILE FIBERS

BACKGROUND OF THE INVENTION

One known method for improving the smoothness of textile fibers is so-called dry paraffinizing. In this process, the yarn to be treated is guided over solid paraffin during winding. Through abrasion, the filament takes up paraffin in a quantity governed by the type of paraffin used, the contact pressure and the rate of travel of the filament.

Unfortunately, this process is attended by serious disadvantages. Thus, to ensure frictionless further processing of the textile material, the paraffin has to be applied in a precisely defined quantity; different types of paraffin being used according to the time of year. During winding, the normal winding speed has to be reduced by 20 to 25%. In addition, suitable temperatures have to be maintained for storing the paraffinized packages of wound yarn.

In the processing of yarns, particularly single yarns, yarn dragging and filament breakages can occur during the paraffinizing treatment. Another disadvantage lies in the possible efflorescence of the paraffin during subsequent steaming and ironing processes.

In addition, dry paraffinizing is generally not sufficient for imparting a good handle to the material. This requires an additional treatment with a standard cationic softening agent.

U.S. Pat. No. 4,122,018 describes preparations based on aqueous paraffin dispersions which are suitable for treating a variety of different textile fibers, such as cellulose fibers, wool fibers, synthetic fibers, or mixtures thereof, and which impart to fibers such as these the smoothness required for further processing and good handle. However, practical experience has shown that yarns of cotton or of cotton/synthetic fibers cannot always be readily treated with wet-paraffinizing agents of the type described in U.S. Pat. No. 4,122,018 without additional hard paraffinizing.

Another important function of textile smoothing agents is to impart satisfactory stitchability to sheet-form textile materials, particularly knitted and woven fabrics. If excessive frictional forces occur during stitching, stitching damage is caused when the filaments are struck or crushed by the needles or suffer heat damage. The consequences of stitching damage are particularly serious in the case of knitted fabrics because the fabrics develop ladders upon mechanical stressing. It is crucially important for the filaments to be able to move within the knitted structure of the fabric. Reduction of the needle penetration forces during stitching on modern high-speed sewing machines has acquired particular significance because machines of this type are mechanically capable of completing up to 7000 stitches per minute. However, this requires more vibration-resistant and hence thicker needles from which the stitches are more easily damaged.

DESCRIPTION OF THE INVENTION

The object of the present invention is to provide smoothing agents in the form of aqueous dispersions which are suitable for treating a variety of different textile fibers, such as cellulose fibers, wool fibers, synthetic fibers or mixtures thereof. More particularly, the object of the present invention is to finish yarns of cotton or cotton/synthetic fiber blends in such a way that, even under adverse commercial conditions, they can be processed into knitted fabrics without any need for additional hard paraffinizing and further in such a way that sheet-form textile materials produced therefrom, preferably woven and knitted fabrics, do not suffer any sewing damage, even on modern high-speed sewing machines.

According to the invention, this object is achieved by use of a smoothing agent for textile fiber materials which has the following composition:

(I) from about 10 to about 30% by weight of oxidized polyethylene having an average molecular weight of from about 3000 to about 8000, a density of from about 0.94 to about 1.01 g/cc, an acid number of from about 25 to about 60, and a saponification number of from about 40 to about 80;

(II) from about 3 to about 10% by weight of at least one cationic emulsifier which is an addition product of from 2 to 20 moles of ethylene oxide and/or propylene oxide and 1 mole of an alkylamine containing from 10 to 22 carbon atoms;

(III) from about 1 to about 5% by weight of at least one carboxylic acid or hydroxy carboxylic acid containing from 1 to 4 carbon atoms;

(IV) from 0 to about 10% by weight of paraffin melting in the range from about 40° to about 70° C.;

(V) from 0 to about 8% by weight of at least one fatty acid ester of 1 mole of a fatty acid containing from 10 to 22 carbon atoms and a monohydric, dihydric or polyhydric alcohol containing from 1 to 20 carbon atoms;

(VI) from 0 to about 10% by weight of at least one of (i) fatty acid amidopolyamine corresponding to the following general formula

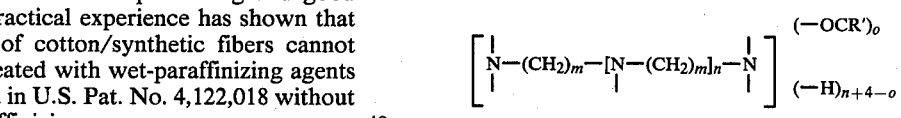

in which —OCR[1] is a fatty acid acyl radical containing from 14 to 22 carbon atoms, m=2 to 6, n=1 to 3 and o=1 to 3; (ii) a quaternary ammonium compound corresponding to the following formula

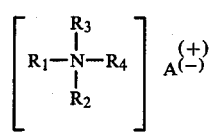

in which $R_1=C_{10}-C_{22}$ alkyl, $R_2=C_1-C_{22}$ alkyl, $R_3=C_2-C_{22}$ alkyl, $R_4=C_1-C_4$ alkyl and A=a salt-forming anion; and (iii) an alkyl imidazolinium salt containing a $C_{12}-C_{20}$ alkyl radical;

(VII) from 0 to about 5% by weight of an ethylene oxide adduct with a higher alcohol containing from 8 to 22 carbon atoms, or with an alkyl phenol containing from 12 to 20 carbon atoms, or with a higher fatty acid containing from 10 to 22 carbon atoms;

(VIII) from 0 to about 3% by weight of a dimethyl polysiloxane dispersion containing approximately 30% of active substance;

(IX) from 0 to about 1% by weight of a protective colloid; and (X) water to 100% by weight.

These smoothing agents are storable, aqueous cationic dispersions having a specific substantivity which enables them to be applied by drawing operations.

Suitable polyethylenes (I) are oxidized types which have saponification numbers of from about 40 to about 80 and acid numbers of from about 25 to about 60 and which are derived from low molecular weight polyethylenes (so-called polyethylene waxes). The oxidized polyethylenes have densities above 0.94 g/cc and preferably in the range of from about 0.98 to about 1.00 g/cc and molecular weights in the range of from about 3000 to about 8000. It has been found that it is only with polyethylene waxes of this type that it is possible to obtain satisfactory results in the compositions of the invention.

The emulsifiers of component (II) above are obtained from fatty amines containing from 12 to 22 carbon atoms and preferably from 16 to 18 carbon atoms by reaction with from 2 to 20 moles of ethylene oxide or propylene oxide, or with both ethylene oxide and propylene oxide, and preferably with from 2 to 10 moles of the alkylene oxide; for example, the adduct of one mole of technical stearylamine with 10 moles of ethylene oxide.

The carboxylic acids (III) are used for salt formation with the fatty acid amidopolyamines when present, or for neutralizing other basic constituents of the composition, and are preferably used in such a quantity that the smoothing agent product was a pH of from about 4 to about 5. Suitable acids (III) are, for example, acetic acid and glycolic acid.

Paraffins melting in the range of from about 50° to about 60° C. are preferably used as the paraffins (IV).

Suitable fatty acid esters (V) include methyl, ethyl, or isotridecyl esters of palmitic acid or stearic acid. Also, esters or partial esters of ethylene glycol, propylene glycol, glycerol, pentaerythritol, trimethylol propane, 2,2'-dimethyl-1,3-dioxypropane or sorbitan, for example, palmitic acid monoglyceride or stearic acid monoglyceride, can be used herein.

The fatty acid amidopolyamines (VI) (i) are preferably obtained from saturated fatty acids or saturated fatty acid mixtures containing from 16 to 22 carbon atoms by reaction with polyalkylene polyamines, such as diethylene triamine, triethylene tetramine, or tetraethylene pentamine; the reaction being carried out in such a molar ratio that at least one amine nitrogen atom capable of salt formation remains intact. The reaction product of 2 moles of stearic acid with 1 mole of diethylene triamine is an example thereof. The fatty acid amidopolyamines are present in the compositions of the invention in the form of their salts with carboxylic acids or hydroxy carboxylic acids containing from 1 to 4 carbon atoms (III above), for example, acetic acid or glycolic acid.

Suitable quaternary ammonium salts (VI) (ii) include lauryl trimethyl ammonium chloride, dodecylbenzyl trimethyl ammonium methosulfate, and distearyl dimethyl ammonium chloride.

An example of an alkyl imidazolinium salt (VI) (iii) is 1-ethyl-1-hydroxyethyl-2-heptadecenyl imidazolinium ethyl sulfate.

Component (VII) can be present in from 0 to about 5% by weight, preferably from about 0.5 to about 1.5% by weight, and is an ethylene oxide adduct with straight-chain or branched-chain, saturated or unsaturated higher alcohols containing from 8 to 22 carbon atoms, perferably from 16 to 18 carbon atoms; for example, an adduct of 20 moles of ethylene oxide with 1 mole of oleyl alcohol, or an adduct with an alkyl phenol containing from 12 to 20 carbon atoms, for example, the adduct of 10 moles of ethylene oxide with 1 mole of nonyl phenol, or an adduct of ethylene oxide with a higher fatty acid containing from 10 to 22 carbon atoms, or mixtures of two or more of the above adducts. The ethylene oxide content of the adducts should amount to between about 35 and about 85% by weight. The ethylene oxide adducts with higher alcohols and alkyl phenols are preferred for use herein.

Suitable silicones (VIII) are, in particular, dimethyl polysiloxanes having a viscosity of from about 350 to about 30,000 cSt and preferably from about 10,000 to about 20,000 cSt, and also nonionically or anionically modified dimethyl polysiloxanes.

Preferred protective colloids (IX) are methyl cellulose, hydroxyethyl cellulose, glue, polyvinyl alcohol or gum arabic.

The composition is made up to 100% by weight with water (X) and converted into a stable dispersion which can be effected in the usual manner by stirring, optionally at elevated temperatures and using stirrers, dispersers, homogenizers, etc. It is preferred to use distilled or demineralized water.

The smoothing agents according to the invention can be used for finishing textile fibers, such as cotton, wool, cellulose, polyacrylonitrile, polyester, polyamide, triacetate, polyethylene, polypropylene fibers, and blends thereof, preferably cotton, wool and blends thereof with polyester or polyacrylonitrile. The textile fibers are in the form of flocks, combed slivers, yarns, woven fabrics, knitted fabrics, or nonwoven fabrics and preferably in the form of yarns, knitted fabrics and woven fabrics, and may be natural white, bleached or dyed.

The smoothing agents may be applied using standard apparatus, such as dyeing machines for cross-wound packages, strands or muffs, in winch vats or in jet-dyeing machines. The smoothing agents are prefereably applied by drawing from aqueous solution with a solution ratio of from about 1:8 to about 1:40, at a solution pH of from about 2 to about 8 and at a temperature of from about 25° to about 80° C.; the concentration of active smoothing agent amounting to between about 0.2 and about 3.0% by weight and preferably to between about 0.2 and about 2.5% by weight, based on the weight of the fabric. Finishing may be carried out in the presence of electrolytes, such as sodium acetate, sodium sulfate, sodium chloride, etc.

The smoothing agents may also be applied to the textile materials by a so-called forced application process, for example in a padding machine or in a back washing machine. In the padding process, the smoothing agent is used in a concentration of from about 2 to about 10 g/l and preferably in a concentration of from about 4 to about 7 g/l, expressed as 100% active substance, optionally in conjunction with high-grade finishing agents, such as creaseproofing or shrinkproofing agents.

The textile materials finished in accordance with the invention show a soft, supple and elegant handle so that there is no need for additional softening agents to be applied.

Compared with other known wet-paraffinizing agents, the smoothness values (friction values) obtained with the present smoothing agents are distinctly lower, particularly in the case of cotton and cotton blends, and show a high degree of uniformity, providing for satisfactory flat and circular knitting. This effect occurs particularly under standard commercial drying conditions. There is no need for additional hard paraffinizing. The flat and circular knitted fabrics produced in accordance with the invention show good and even stitch patterns.

The needle penetration forces required for stitching woven and knitted fabrics are unusually low. This applies both to fabrics treated exclusively with the smoothing agents according to the invention and also to fabrics treated further with a standard synthetic resin finish.

The substantivity of the smoothing agents is very good and promotes good liquor utilization. The smoothing agents show very high thermal stability so that no fumes are given off during the usual drying processes, nor do any deposits accumulate in the dryer.

The invention will be illustrated by the following examples, which are given for that purpose only and not for purposes of limitation.

EXAMPLES

Smoothing agents of the invention (A)

17.0% by weight of oxidized polyethylene having the following characteristics: average MW 4000, acid number 28, saponification number 45, density 0.99 g/cc.
5.5% by weight of paraffin, m.p. 52°-54° C.
3.5% by weight of stearic acid isotridecyl ester
5.0% by weight of stearylamine with 2 moles of ethylene oxide
0.2% by weight of sodium bisulfite
2.4% by weight of 60% acetic acid
66.4% by weight of water.

(B)

23.0% by weight of oxidized polyethylene having the following characteristics: average MW 4500, acid number 30, saponification number 45, density 1.00 g/cc
6.5% by weight of stearylamine with 10 moles of ethylene oxide
0.3% by weight of sodium bisulfite
3.5% by weight of 60% acetic acid
66.7% by weight of water.

(C)

14.5% by weight of oxidized polyethylene having the following characteristics: average MW 4000, acid number 28, saponification number 45, density 0.99 g/cc
3.8% by weight of fatty acid amidopolyamine (2 moles of behenic acid and 1 mole of tetraethylene pentamine)
1.6% by weight of $C_{18}$-fatty alcohol with 14 moles of ethylene oxide
0.8% by weight of dimethyl polysiloxane, 12,500 cSt
3.0% by weight of 60% acetic acid
3.2% by weight of stearylamine with 5 moles of ethylene oxide
0.2% by weight of sodium bisulfite
72.9% by weight of water.

Comparison smoothing agents (D)

23.0% by weight of oxidized polyethylene having the following characteristics: average MW 1650, acid number 15, saponification number 50, density 0.93 g/cc
6.5% by weight of stearylamine with 10 moles of ethylene oxide
3.5% by weight of 60% acetic acid
0.3% by weight of sodium bisulfite
66.7% by weight of water.

This example corresponds to the formulation of (B) above but contains a polyethylene wax of lower density.

(E)

7.5% by weight of palmitic acid methyl ester
22.5% by weight of paraffin m.p. 52°-54° C.
4.0% by weight of fatty acid amidopolyamine (2 moles of behenic acid and 1 mole of tetraethylene pentamine)
1.4% by weight of distearyl dimethyl ammonium chloride
4.5% by weight of 60% of acetic acid
60.1% by weight of water.

This example substantially corresponds to the composition of the smoothing agent (I) of U.S. Pat. No. 4,122,018.

The smoothing agents (A)-(B) and (D)-(E) are stable dispersions which are miscible with water in any ratio.

EXAMPLES OF THE APPLICATION OF SMOOTHING AGENTS

EXAMPLE 1

Pure cotton yarn was dyed with indanthrene dyes using an HT cheese dyeing machine. The aftertreatment was carried out with fresh liquor, liquor ratio 1:10, acetic acid, pH 5.0. The smoothing agents (A)-(C) and comparison softeners (D) and (E) were applied over a period of 20 minutes at 45° C. in quantities equivalent to 0.6% of active substance. The cheeses were then dried under suction in the machine, drying being completed in a pressure dryier.

The friction values were determined by means of a Schlafhorst friction value balance. The results are set out in the following Table.

EXAMPLE 2

Knitted cotton fabric dyes with reactive dyes was aftertreated as follows in a winch vat: application of the described smoothing agents (A)-(C) and the comparison softeners in quantities equivalent to 0.8% of active substance, acetic acid, pH 4.5, liquor ratio 1:25, 25 minutes at 45° C. The knitted fabric was dried on a tenter frame.

The sewing needle penetration forces were measured using a Pfaff type 483 high-speed double backstitch sewing machine with a built-in penetration force recorder at a sewing speed of 400 stitches per minute. The average values from 50 individual penetrations are shown in the following Table.

EXAMPLE 3

Knitted cotton fabric was subjected to high-grade finishing in a padding machine using 60 g/l of a reactant resin (Stabitex FRD®) and 6.0 g/l of magnesium chloride as catalyst. Drying and condensation were carried out on a tenter frame. The above smoothing agents and comparison softeners were added to the liquors in quantities of 8.0 g/l, based on 100% of active substance, in order to improve stitchability and also to impart a soft handle.

100% squeeze out was obtained in the padding machine. The stitchability of the fabric was assessed in the same manner as described in EXAMPLE 2. The results obtained are given in the following Table.

TABLE

| Smoothing Agent | Friction values cotton-yarn, count 50/1 Example 1 | Penetration forces/average values (cN) knitted cotton fabric: Drawing process Example 2 | Penetration forces/average values (cN) knitted cotton fabric: Padding/high grade finishing Example 3 |
|---|---|---|---|
| (A) | 0.17–0.19 | 672 | 398 |
| (B) | 0.19–0.21 | 704 | 469 |
| (C) | 0.20–0.22 | 710 | 488 |
| (D) | 0.27–0.29 | 890 | 616 |
| (E) | 0.22–0.24 | 845 | 525 |

What is claimed is:

1. A smoothing agent for textile fibers which comprises (I) from about 10 to about 30% by weight of at least one oxidized polyethylene having an average molecular weight of from about 3000 to about 8000, a density of from about 0.94 to about 1.01 g/cc, an acid number of from about 25 to about 60 and a saponification number of from about 40 to about 80;

(II) from about 3 to about 10% by weight of at least one cationic emulsifier which is an addition product of from 2 to 20 moles of ethylene oxide and/or propylene oxide and 1 mole of an alkylamine containing from 10 to 22 carbon atoms;

(III) from about 1 to about 5% by weight of at least one carboxylic acid or hydroxy carboxylic acid, wherein said carboxylic acid or hydroxy carboxylic acid contains from 1 to 4 carbon atoms;

(IV) from 0 to about 10% by weight of paraffin melting in the range from about 40° to about 70° C.;

(V) from 0 to about 8% by weight of a fatty acid ester of 1 mole of a fatty acid containing from 10 to 22 carbon atoms and a monohydric, dihydric, or polyhydric alcohol containing from 1 to 20 carbon atoms;

(VI) from 0 to about 10% by weight of either (i) a fatty acid amidopolyamine corresponding to the following general formula

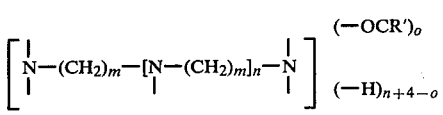

in which —OCR$^1$ is a $C_{14}$–$C_{22}$ fatty acyl radical, m=2–6, n=1–3, o=1–3; or (ii) a quaternary ammonium compound corresponding to the following formula

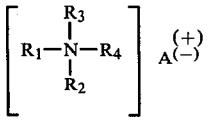

in which $R_1$=$C_{10}$–$C_{22}$ alkyl, $R_2$=$C_1$–$C_{22}$ alkyl, $R_3$=$C_2$–$C_{22}$ alkyl, $R_4$=$C_1$–$C_4$ alkyl, and A=a salt-forming anion; or (iii) an alkyl imidazolinium salt containing a $C_{12}$–$C_{20}$ alkyl radical;

(VII) from 0 to about 5% by weight of an ethylene oxide adduct with a higher alcohol containing from 8 to 22 carbon atoms or with an alkyl phenol containing from 12 to 20 carbon atoms or with a higher fatty acid containing from 10 to 22 carbon atoms;

(VIII) from 0 to about 3% by weight of a dimethyl polysiloxane dispersion containing approximately 30% of active substance;

(IX) from 0 to about 1% by weight of a protective colloid; and (X) the remainder to 100% by weight of water.

2. A smoothing agent in accordance with claim 1 wherein the oxidized polyethylene in (I) has a density of from about 0.98 to about 1.00 g/cc.

3. A smoothing agent in accordance with claim 1 wherein the emulsifier in (II) is an addition product of from 2 to 10 moles of ethylene oxide and/or propylene oxide and 1 mole of an alkylamine containing from 16 to 18 carbon atoms.

4. A smoothing agent in accordance with claim 3 wherein the alkylamine is stearylamine.

5. A smoothing agent in accordance with claim 1 wherein the smoothing agent has a pH of from about 4 to about 5.

6. A smoothing agent in accordance with claim 1 wherein the carboxylic acid or hydroxy carboxylic acid in (III) is either acetic acid, glycolic acid, or a mixture thereof.

7. A smoothing agent in accordance with claim 1 wherein the paraffin in (IV) has a melting point in the range of from about 50° to about 60° C.

8. A smoothing agent in accordance with claim 1 wherein the fatty acid ester in (V) is an ester of palmitic acid or stearic acid.

9. A smoothing agent in accordance with claim 1 wherein the ethylene oxide adduct in (VII) is present in from about 0.5 to about 1.5% by weight.

10. A smoothing agent in accordance with claim 1 wherein the dimethyl polysiloxane in (VIII) has a viscosity of from about 350 to about 30,000 cSt.

11. A smoothing agent in accordance with claim 1 wherein the smoothing agent is in the form of a stable dispersion.

* * * * *

UNITED STATES PATENT AND TRADEMARK OFFICE

CERTIFICATE OF CORRECTION

PATENT NO. : 4,474,668

DATED : October 2, 1984

INVENTOR(S) : Manfred Petzold et al.

It is certified that error appears in the above-identified patent and that said Letters Patent is hereby corrected as shown below:

Title page [76]: The name of the third inventor should read--Rudolf Veitenhansl--.

Title page item [73]: insert--[73] Assignee: Henkel Kommanditgesellschaft auf Aktien, Duesseldorf, Federal Rep. of Germany--.

Title page item Attorney, Agent or Firm: insert--Attorney, Agent or Firm—Ernest G. Szoke; Henry E. Millson, Jr.; Mark A. Greenfield--.

Column 3, line 30: "was" should read--has--.

Signed and Sealed this

*Seventeenth* Day of *September 1985*

[SEAL]

*Attest:*

*Attesting Officer*

DONALD J. QUIGG

*Commissioner of Patents and Trademarks—Designate*